United States Patent [19]

Adorni

[11] Patent Number: 4,506,814

[45] Date of Patent: Mar. 26, 1985

[54] REVOLVING-LADLE TURRET FOR CONTINUOUS CASTING PLANTS

[75] Inventor: Franco Adorni, Milan, Italy

[73] Assignee: Innse Innocenti Santeustacchio S.p.A., Brescia, Italy

[21] Appl. No.: 425,652

[22] Filed: Sep. 28, 1982

[30] Foreign Application Priority Data

Oct. 2, 1981 [IT] Italy ..... 24273 A/81

[51] Int. Cl.[3] ..... B22D 41/00

[52] U.S. Cl. ..... 222/591; 222/168; 164/438; 248/421

[58] Field of Search ..... 222/591, 606, 607, 160, 222/168, 168.5; 164/437, 438, 336; 248/421, 188.2, 188.3, 180

[56] References Cited

U.S. PATENT DOCUMENTS

| | | | |
|---|---|---|---|
| 3,773,228 | 11/1973 | Koch et al. | 164/438 |
| 3,866,665 | 2/1975 | Schoffman | 164/438 |
| 4,121,802 | 10/1978 | Kluting et al. | 248/421 |
| 4,286,738 | 9/1981 | Blum | 222/591 |

FOREIGN PATENT DOCUMENTS

| | | | |
|---|---|---|---|
| 7420103 | 11/1976 | France | 164/438 |

*Primary Examiner*—Joseph J. Rolla
*Assistant Examiner*—Lawrence J. Miller
*Attorney, Agent, or Firm*—Fleit, Jacobson, Cohn & Price

[57] ABSTRACT

A revolving-ladle turret having a turret member supporting a platform which rotates around a vertical axis and which is furnished with ladle-carrying arms. The turret member is supported by a pair of articulated linkages similar to parallelograms of the double-handle type. The upper or bridge sides of the parallelograms are horizontal and rigidly supported by the structure carrying the machine. These parallelograms have their respective handles shaped at right angles and are linked to the turret member in positions which are symmetrical to it with respect to the axis of rotation of the platform and which effectively resist the torque which works on the turret due to the constant unevenness of the loads which act on the turret because of variations in the amounts of materials in the ladles.

3 Claims, 3 Drawing Figures

REVOLVING-LADLE TURRET FOR CONTINUOUS CASTING PLANTS

BACKGROUND OF THE INVENTION

1. Field of the Invention

The present invention relates to a revolving-ladle turret for use in plants for the continuous casting of molten steel. More particularly, the invention relates to ladles of the type having a turret member supported by a base structure with respect to which the turret member is vertically moveable, a platform supported by the turret member so that it may rotate around a vertical axis, at least two ladle-carrying arms which extend out from positions which are diametrically opposite on the platform, motor elements for rotating the platform, and motor elements for controlling the vertical movements of the turret member and of the platfor supported by it.

2. Description of the Art

It is known that by means of a turret of the above-mentioned type it has become possible to halve or at least reduce by a substantial amount the down time between two successive feeds of molten steel into the distributor of a continuous casting plant. Actually, while a first ladle, held in the casting position, unloads steel into the distributor, a second ladle full of molten steel can be loaded on the other ladle-carrying arm. At the end of these operations, the turret and the respectively empty and full ladles are raised, rotated by 180 degrees and then lowered to the beginning height to initiate the simultaneous operations of unloading molten metal from the full ladle and substitution of the empty ladle with anothe which has been previously filled.

during each of the above-mentioned movements the ladle-carrying arms must remain horizontal.

Satisfaction of this necessity is very difficult to achieve due to the constant and evident situation in which there are unbalanced loads which act on the turret. In fact, the ladles carried at the ends of the turret arms have large, different, and quite variable weights depending on the operating phase of the turret at any one time. This means that the resultant force of the loads which act on the turret not only does not coincide ever with the axis of the turret itself, but its distance from this axis varies between two limiting positions which occur when a full ladle is located to have its contents emptied and after the contents of the ladle have been emptied.

Exactly when the resultant force of the loads is in one of these two limiting positions, the vertical movement operations of the turret are carried out by the appropriate motor elements. These elements are generally comprised of two hydraulic cylinders which are symmetrically arranged with respect to the vertical axis of the turret. Since the resultant of the thrust of these cylinders coincides with the vertical axis of rotation while the resultant of the loads is in one of the two limiting positions, an unbalancing torque works against the turret during the vertical movements of the turret and must be effective resisted, or, better, eliminated.

For this purpose, changes have been proposed for affecting the hydraulic cylinders for raising and supporting the turret so that the action line of the resultant of their thrusts would be moved, from time to time, in order to coincide with the action line of the resultant of the unbalanced loads weighing on the turret.

Thus, devices and mechanisms, for example, have been devised to appropriately regulate the pressures of the operating fluids in the cylinders. Also, devices have been devised for balancing and/or compensating which, besides their recognized unreliability, have presented the inconvenience of being very complex from both the structural and functional points of view.

SUMMARY OF THE INVENTION

The problem which is at the bottom of this invention is that of realizing a revolving-ladle turret which includes a simple structure and a reliable functional device capable of effectively resisting the unbalancing torque discussed above, above all on the occasion of the vertical movements of the turret.

This problem is solved by the invention which provides an improved revolving ladle turret of the type previously discussed. The inventive turret has a turret member moveable in a horizontal direction on the base structure that is suppoted by this structure by means of two identical articulated linkages similar to parallelograms which have a horizontal bridge side, rigidly supported by the base structure and handles furnished with protruding parts which are essentially in the shape of a right angle, and are identical and equally spaced, the free ends of which are linked to the turret member in positions which are symmetrical to it about the said vertical axis.

BRIEF DESCRIPTION OF THE DRAWINGS

Characteristics of the invention will be better understood by reference to a representative embodiment of the revolving-ladle turret according to the invention, as follows, referring to the attached drawings which are provided as an example but are not intended to be limiting. In the drawings.

DESCRIPTION OF THE PREFERRED EMBODIMENT

Figure 1:
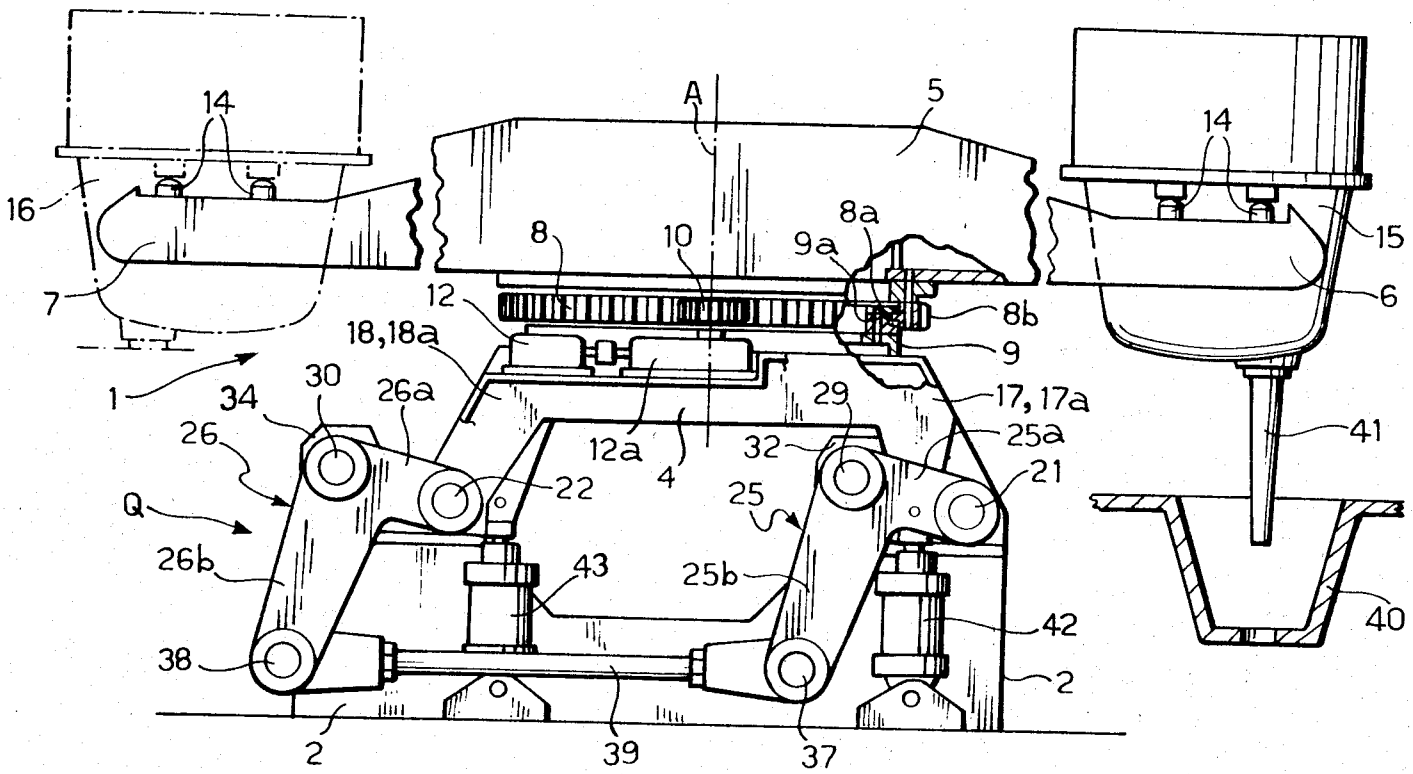
FIGS. 1 and 2 schematically represent elevational views, partially in cross-section, of a revolving-ladle turret according to the invention in two operating circumstances.

With reference to the drawings, one embodiment of a revolving-ladle turret, generally designated 1, is illustrated. The turret 1 has a fixed, or base, structure 2 and a moveable structure, which is supported by the base structure 2.

The moveable structure includes, in turn, a turret member 4 and a platform 5. In diametrically opposited positions with respect to the platform 5 and rigidly joined to it, there are two extending ladle-carrying arms 6, 7 furnished with conventional elements which are schematically indicated with 14, for grasping and holding the respective ladles 15, 16. This platform 5 is mounted on the turret member 4 so as to allow it to rotate about a vertical axis A. For this reason, the platform 5 is furnished on a lower surface with a ring bearing 8, coaxially fitted to rotate on a collar part 9 which is provided on top of the turret member 4. Between the bearing 8 and the collar part 9, there is a sliding engagement for guiding and support provided in a traditional fashion. For example, on the bearing 8 an annular protrusion **8*a* is formed, turned toward the inside, while, on the collar part 9, an annular groove 9*a*** is formed on the outside.

Figure 3:
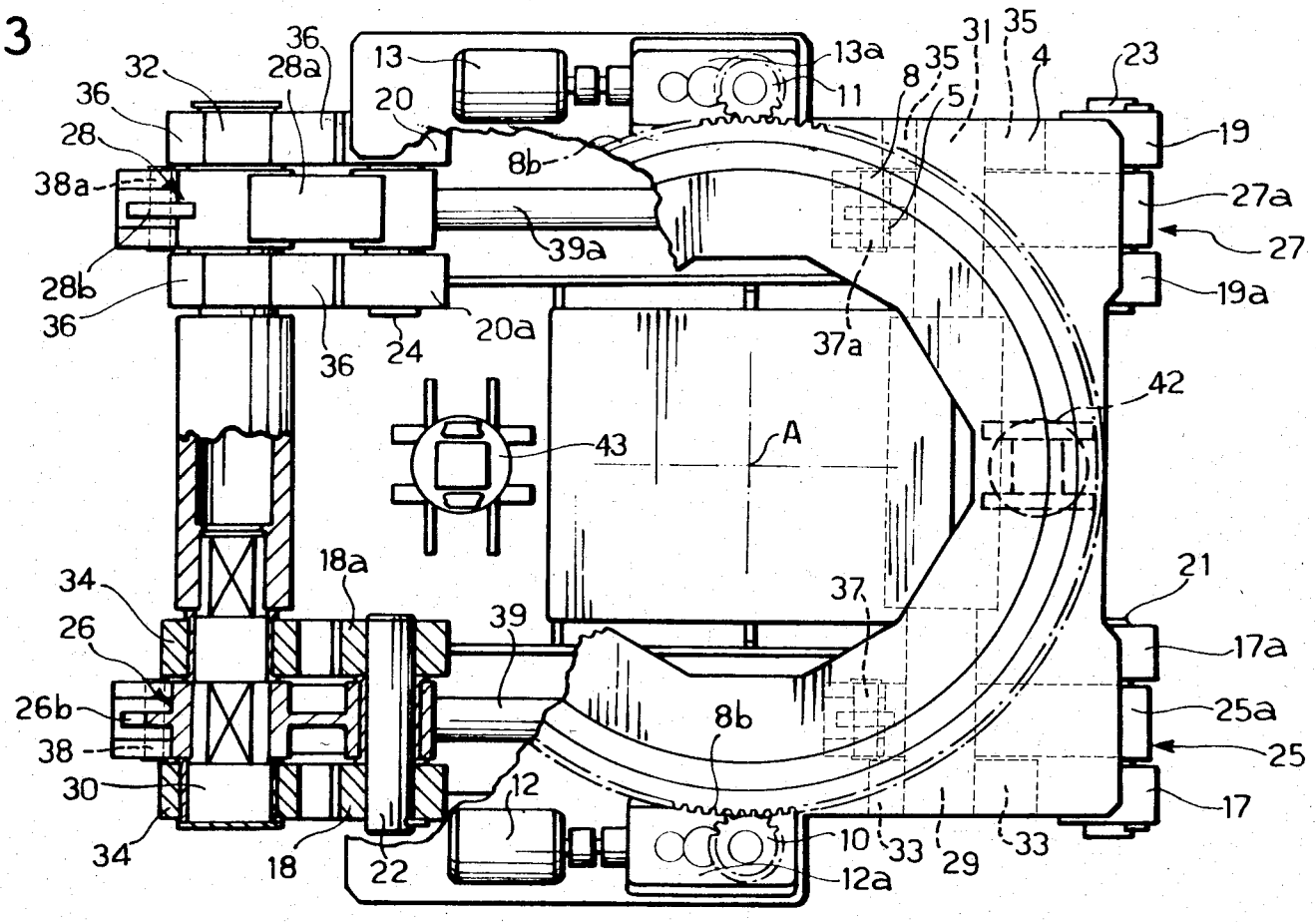
FIG. 3 shows a plan view, partially broken away, of the same turret as in FIG. 1.

A toothing 8b is circumferentially fixed or formed on the bearing 8, and it is engaged with motorized pinion gears 10, 11, carried on the turret member 4, as illustrated in FIG. 3. Each pinion is driven by a corresponding motor 12, 13 through gear boxes 12a, 13a.

The turret member 4 preferably is formed with four sides and is furnished on its lower surface, corresponding to each of its corners, with plate-shaped ears 17–17a, 18–18a, 19–19a, 20–20a, which are identical, parallel and extend toward the outside downward. Each of these pairs of plate-shaped ears supports a respective horizontal pin 21, 22, 23 and 24, the axes of which are coplanar and symmetrically arranged about the axis A. The pins 21 to 24 are linked to two articulated linkages similar to parallelograms of the double-handle type, by means of which the turret member 4 is supported by the base stru cture 2.

Since the articulated linkages or parallelograms Q are both structurally and functionally identical, only one of them is described below. This description uses the reference numbers shown between parenthesis as those of the other articulated parallelogram.

Each articulated parallelogram Q includes a pair of bell cranks 25, 26 (27, 28) which are identical and similarly situated, with their fulcrum on respective pins 29, 30 (31, 32) supported at the same height by supports 33, 34 (35, 36) which are rigidly fixed to the base structure 2. The arms 25a, 26a (27a, 28a) of the bell cranks, have their free or outer ends engaged on pins 21, 22 (23, 24). Outer or free ends of the arms 25b, 26b (27b, 28b) of the bell cranks are rotably connected to pins 37, 38 (37a, 38a) which are carried on thee extremities of a rigid rod 39 (39a).

While the arms 25b, 26b constitute the handles of the parallelogram Q, the rod 39 constitutes its connecting rod.

The linkages have been described as parallelograms because the pins 21, 22, 38, 37 of one articulated linkage Q and the similar pins of the other articulated linkage Q move in the same manner as the apexes of a parallelogram. Similarly, the pins 29, 30, 38, 37 also define apexes of a parallelogram. A plane containing the pins or bridge sides 29-30 and, respectively, 31-32, of the parallelograms Q is horizontal and extends parallel to a plane passing through like parts of the ladle-carrying arms 6, 7 when the arm 6 holds the corresponding ladle 15 vertically above a distributor 40. It also should be noted that the pins 29, 30, 31 and 32 are used to connect the articulated linkages Q to the base structure 2.

In accordance with a preferred method of realization, the fulcrum pins 29 and 31 are aligned, that is, they are comprised of a single pin. The fulcrum pins 30 and 32 FIG. 3) are likewise comprised of a single pin. With proper dimensioning of these pins, the articulated parallelograms become reciprocally distanced and are made rigid by cross members.

Numbers 42 and 43 in the drawings identify two hydraulic cylinders which are pinned below to the base structure 2 and pinned above to the turret member 4 inpositions which are intermediate to it with respect to the pair of pins 21, 23 and 22, 24, that is, the pins 21, 23 and 22, 24 are outwardly spaced from the cylinders 42 and 43. These hydraulic cylinders are used for raising and holding the turret 1 when required.

The functioning of the revolving-ladle turret, particularly under the circumstances of vertical movements, is as follows.

In an initial state (FIG. 1), the turret is in the "lowered" position. Ladle 15 is held vertically above a distributor 40 toward and into which a conduit 41 extends for feeding molten metal or other material. The ladle 15 is empty because the unloading of the molten metal has been completed from it into the distributor 40 below. Ladle 16, which is being held in the loading position, is full of the pre-established quantity of molten steel. From this initial state in which, clearly, the loads acting on the turret are not balanced, the turret is raised to a pre-established height such that the conduit 41 is safely out of the distributor40 and, then is revolved 180 degrees around the axis A to convey the empty ladle 15 into the loading position and the full ladle 16 into the position for unloading into the distributor 40.

At the time of this raising, the straight-line action of the resultant of the ladle weights is clearly moved form axis A toward the full ladle 16, while the straight-line action of the resultant of the thrusts of the hydraulic cylinders is coincident with the said axis A. The consequent unbalancing torque, which is counter-clockwise, favors the cylinder 42 in its work of raising the turret, while it hinders the cylinder 43. The raising of the turret under these conditions, without use of the present invention, would signify a loss of the required horizontal state of the ladle-carrying arms 6 and 7 because the point at which the cylinder 42 is applied to the turret member 4 would be lifted higher than the corresponding point for cylinder 43.

The desired horizontal relationship of the arms 6 and y is maintained by the presence of the two devices Q of the articulated four-sided shape previously discussed. In fact, their presence and their arrangement oblige every point on the turret member 4 to effect synchronous movements. Specifically, and still with reference to FIGS. 1 and 2, any stress which would tend to effect an angular counter-clockwise movement of the bell cranks 25 and 27, would effect an identical counter-clockwise angular movement in cranks 26 and 28, with a substantial lightening of the load which acts on cylinder 43. In practice, the presence of the articulated parallelograms establishes an efficient mutual assistance between the hydraulic cylinders which are intended for raising and holding up the revolving-ladle turret.

Figure 2:
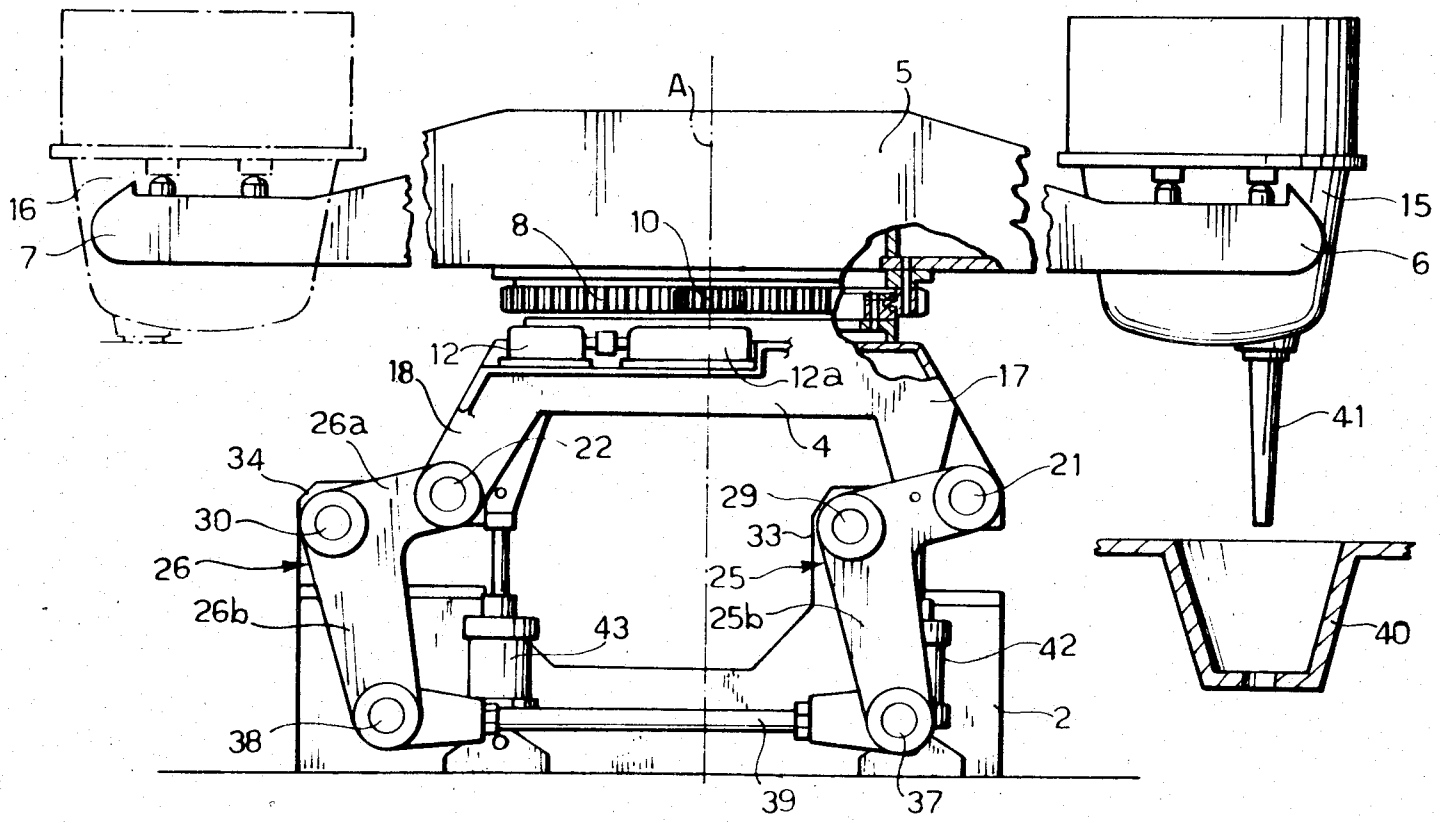

At the end of the lifting phase, the turret is in the position illustrated by FIG. 2, and it should be noted that, in order to reach this position, the turret has undergone a movement which has both vertical and horizontal components. To permit this horizontal movement, it has become necessary to eliminate the customary movement of the turret on rigid vertical guides, and this is in contrast to a widely accepted technical prejudice.

The articulated quadrilaterals comprised of rigid elements confer on the ladle-carrying arms 6 and 7 the required horizontal state, and they offer a surprising, notable and recognized reliability of operation, besides resulting in simple realization and equally simple maintenance.

Other variations are available to the expert in this field, and therefore they fall within the scope of protection as defined in the following claims.

What is claimed is:

1. Revolving-ladle turret comprising:

a fixed base structure;

a turret member supported by and moveable relative to said base structure;

a pair of linkage means for interconnecting said base structure and said turret member, each of said linkage means comprising a first and a second bell crank, each bell crank having an upper arm with an outer end connected to a portion of said turret member, an intermediate portion connected to said base structure so that the bell crank is pivotally moveable, and a lower arm, said linkage means further comprising a rod interconnecting lower portions of said lower arms so that upward movement of an upper arm of one of said bell craks results in upward movement of the upper arm of the other bell crank of the linkage means and upward movement of said turret member;

a platform supported by said turret member for rotation about a vertical axis;

ladle-carrying arms extending outwardly from diametrically opposed portions of said platform;

means for vertically moving said platform and said turret member; and means for rotating said platform with respect to said turret member.

2. Revolving-ladle turret for continuous casting steel plants comprising:

a turret member;

a base structure supporting the turret member, the turret member being vertically moveable with respect to the base member;

a platform rotatably supported by and vertically moveable with the turret member;

a pair of ladle-carrying arms which extend out from diametrically opposed positions on the platform;

motor means for rotating the platform about an axis (A);

means for moving the turret member and the platform toward and away from the base structure; and linkage means for interconnecting said base structure and said turret member so that the turret member is moveable in a horizontal movement with respect to the base structure during vertical movements of the turret member, said linkage means being in the form of two identical articulated parallelograms including pivot pins carried by the base structure and having link means pivotally supported by said pivot pins, a first end of the link means spaced from saidpivot and pivotally connected to the turret member and a second end of said link means spaced from said pivot pin and pivotally connected to a connecting rod that extends between a pair of said second ends, whereby said articulated parallelograms compensate for unbalance resulting from unequal loads supported by said ladle-carrying arms.

3. Revolving-ladle turret as in claim 2, wherein the articulated parallelograms are spaced a pe-established distance from each other and are each braced by respective cross members.

* * * * *